US009548178B2

(12) United States Patent
Shu

(10) Patent No.: US 9,548,178 B2
(45) Date of Patent: Jan. 17, 2017

(54) FUSE STRUCTURE AND MONITORING METHOD THEREOF

(71) Applicant: UNITED MICROELECTRONICS CORP., Hsin-Chu (TW)

(72) Inventor: Yu-Hsiang Shu, Hsinchu (TW)

(73) Assignee: UNITED MICROELECTRONICS CORP., Hsin-Chu (TW)

( * ) Notice: Subject to any disclaimer, the term of this patent is extended or adjusted under 35 U.S.C. 154(b) by 176 days.

(21) Appl. No.: 14/586,900

(22) Filed: Dec. 30, 2014

(65) Prior Publication Data

US 2016/0172139 A1 Jun. 16, 2016

(30) Foreign Application Priority Data

Dec. 15, 2014 (CN) ..... 2014 1 0770334

(51) Int. Cl.
*H01H 71/04* (2006.01)
*H01H 85/48* (2006.01)

(52) U.S. Cl.
CPC ..... *H01H 85/48* (2013.01); *H01H 2071/044* (2013.01)

(58) Field of Classification Search
CPC ..... H01L 2924/0002; H01L 2924/00; H01L 23/5252; H01L 23/5256; H01L 27/10; H01L 27/224; H01L 27/228; H01L 27/2409; H01L 27/2436; H01L 27/2463; H01L 45/06; H01L 45/1233; H01L 45/144; H01H 2071/044; H01H 71/04; H01H 85/48
USPC ..... 324/550
See application file for complete search history.

(56) References Cited

U.S. PATENT DOCUMENTS

| | | | | |
|---|---|---|---|---|
| 5,731,733 | A | 3/1998 | Denham | |
| 6,436,738 | B1 | 8/2002 | Yu | |
| 6,541,983 | B2 | 4/2003 | Khoury | |
| 7,145,346 | B2 | 12/2006 | Chung | |
| 2004/0124458 | A1* | 7/2004 | Kothandaraman | H01L 23/5252 257/300 |
| 2006/0280016 | A1* | 12/2006 | Chen | G11C 17/18 365/225.7 |
| 2015/0003143 | A1* | 1/2015 | Chung | H01L 27/10 365/96 |

* cited by examiner

*Primary Examiner* — Vincent Q Nguyen
(74) *Attorney, Agent, or Firm* — Winston Hsu; Scott Margo

(57) ABSTRACT

A fuse structure includes a substrate, a fuse element, and an auxiliary device. The fuse element is disposed on the substrate. The auxiliary device includes a source region and a drain region respectively disposed at two opposite sides of the fuse element. The auxiliary device is configured to monitor and diagnose the fuse element. The source region and the drain region are electrically isolated from the fuse element. A monitoring method of the fuse structure includes following steps. A drain voltage signal is applied to the drain region of the auxiliary device, a gate voltage signal is applied to the fuse element, and a signal from the source region is analyzed to diagnose a condition of the fuse element.

9 Claims, 9 Drawing Sheets

FUSE STRUCTURE AND MONITORING METHOD THEREOF

BACKGROUND OF THE INVENTION

1. Field of the Invention

The present invention relates to a fuse structure and a monitoring method thereof, and more particularly, to a fuse structure including an auxiliary device configured to measuring electrical properties of a fuse element and a monitoring method thereof.

2. Description of the Prior Art

In semiconductor processes, semiconductor components tend to be influenced by all kinds of defects or impurities more easily as the components become smaller and more complicated. If a single metal link, a diode, or a MOS is broken down, the whole chip will fail. To solve this issue, fusible links such as fuses may be employed in an integrated circuit (IC) and used to be selectively blown for ensuring that the IC can work normally.

Generally speaking, fuses are connected to redundant circuits of an IC. When defects are found in the circuit, fuses can be selectively blown for repairing or replacing defective circuits. Additionally, fuses may be designed to provide programming elements, and the circuit may be programmed according to different and customized functional designs.

Fuses are roughly classified into two categories based on their operation: thermal fuse and electrical fuse (efuse). Thermal fuses can be cut by laser for forming open circuit conditions. For efuse, the open circuit condition is formed by electro-migration (EM) effect and appropriate applied current. In addition, efuses applied in semiconductor devices may include a poly efuse, a MOS capacitor anti-fuse, a diffusion fuse, a contact efuse, and a contact anti-fuse.

Generally, the condition of the fuse may be monitored by electrical resistance measurements. However, different blowing conditions of the fuse will lead to differences in resistance, and the blowing conditions cannot be judged merely by the resistance measurement result. If the resistance control standard is set too high, some of the fuses, which can actually function normally, will be judged to be abnormal, and the manufacturing yield will be influenced accordingly.

SUMMARY OF THE INVENTION

It is one of the objectives of the present invention to provide a fuse structure and a monitoring method thereof. An auxiliary device is used to measure electrical properties of a fuse element for monitoring and diagnosing conditions of the fuse element.

A fuse structure is provided in an embodiment of the present invention. The fuse structure includes a substrate, a fuse element, and an auxiliary device. The fuse element is disposed on the substrate. The auxiliary device includes a source region and a drain region respectively disposed at two opposite sides of the fuse element. The auxiliary device is configured to monitor and diagnose the fuse element. The source region and the drain region are electrically isolated from the fuse element.

A monitoring method of a fuse structure is provided in another embodiment of the present invention. The monitoring method includes following steps. First, a fuse structure is provided. The fuse structure includes a substrate, a fuse element, and an auxiliary device. The fuse element is disposed on the substrate. The auxiliary device includes a source region and a drain region respectively disposed at two opposite sides of the fuse element. The auxiliary device is configured to monitor and diagnose the fuse element. The source region and the drain region are electrically isolated from the fuse element. Then, a drain voltage signal is applied to the drain region of the auxiliary device, a gate voltage signal is applied to the fuse element, and a signal from the source region is analyzed to diagnose a condition of the fuse element.

In the fuse structure and the monitoring method thereof in the present invention, electrical properties of the fuse element may be measured through the auxiliary device so as to monitor and diagnose the conditions of the fuse element. Another way to diagnose the condition of the fuse element except the electrical resistance may be provided accordingly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
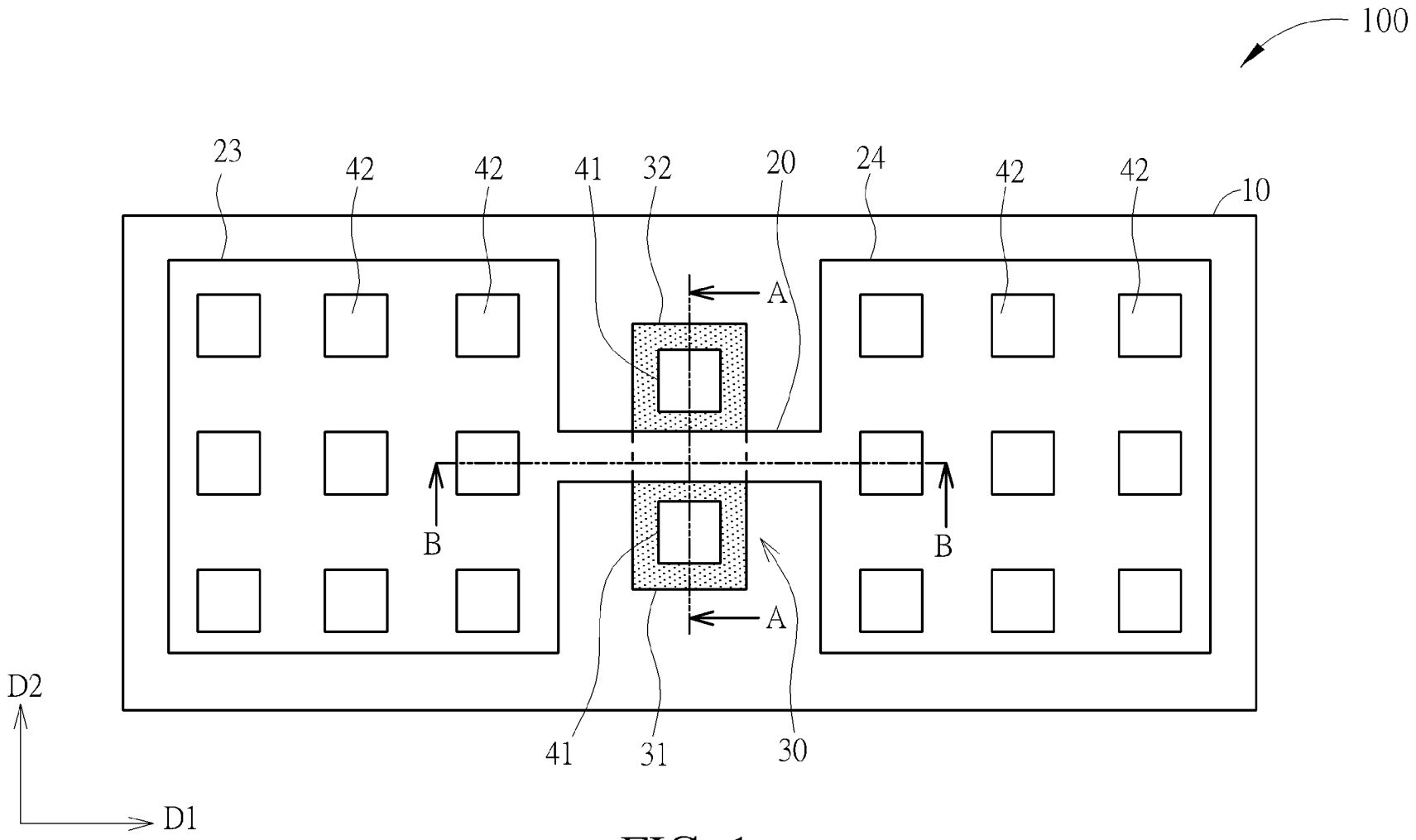
FIG. 1 is a schematic drawing illustrating a top view of a fuse structure according to a preferred embodiment of the present invention.
Figure 2:
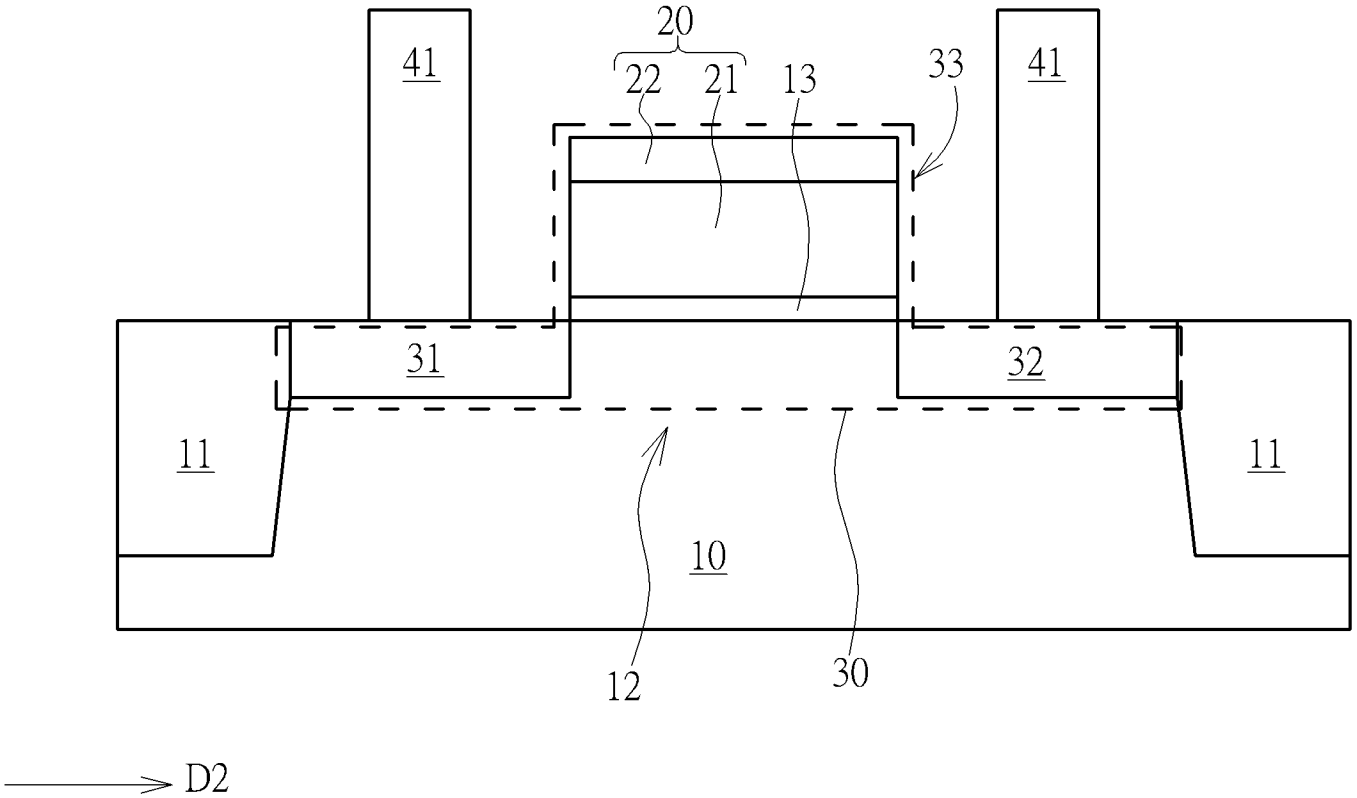
FIG. 2 is a schematic cross-sectional diagram taken along a line A-A' in FIG. 1.
Figure 3:
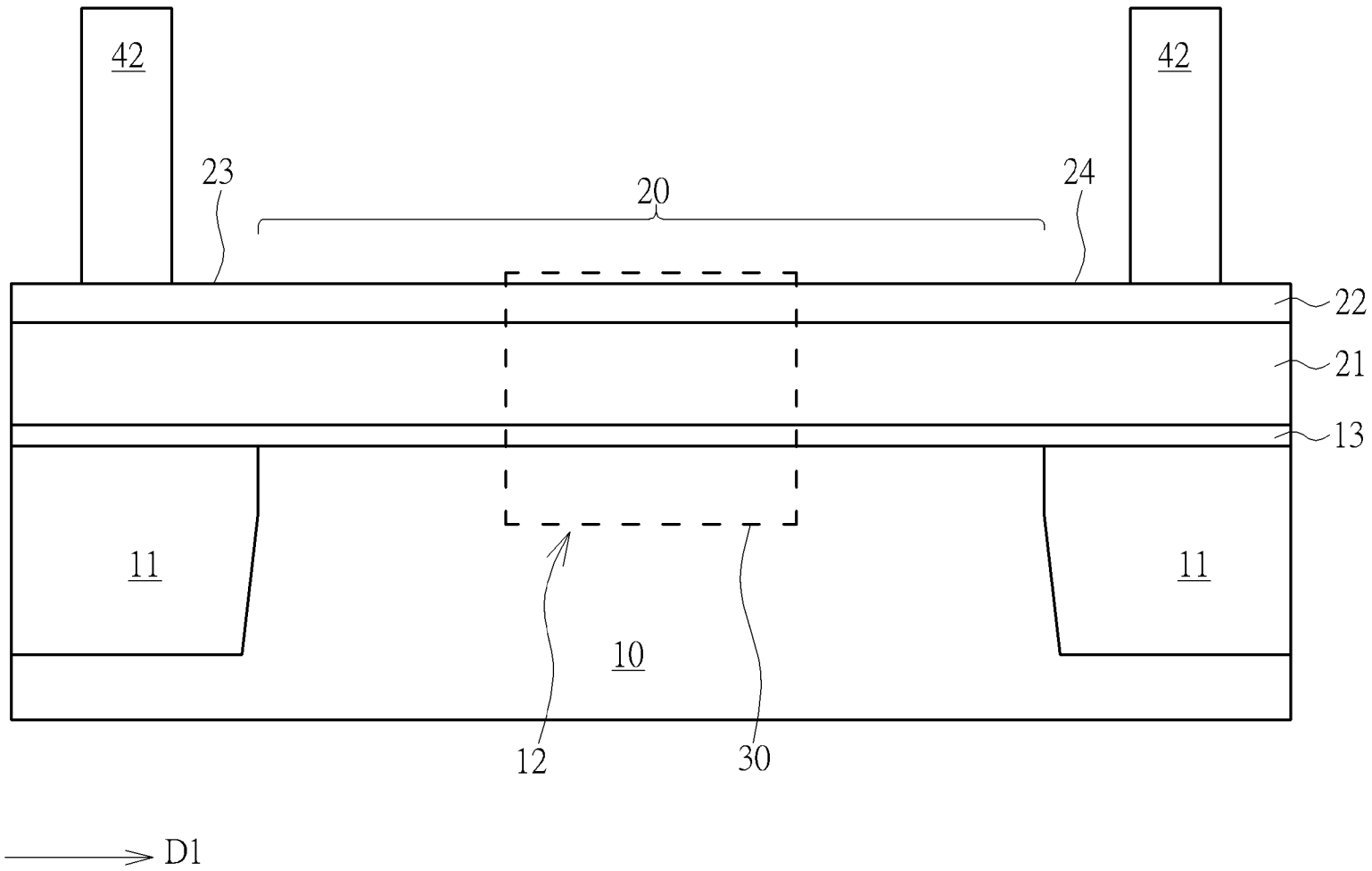
FIG. 3 is a schematic cross-sectional diagram taken along a line B-B' in FIG. 1.

Please refer to FIGS. 1-3. FIG. 1 is a schematic drawing illustrating a top view of a fuse structure according to a preferred embodiment of the present invention. FIG. 2 is a schematic cross-sectional diagram taken along a line A-A' in FIG. 1. FIG. 3 is a schematic cross-sectional diagram taken along a line B-B' in FIG. 1. As shown in FIGS. 1-3, a fuse structure 100 is provided in this embodiment. The fuse structure 100 includes a substrate 10, a fuse element 20, and an auxiliary device 30. The substrate 10 in this embodiment may include a silicon substrate, and epitaxial substrate, a silicon germanium substrate, a silicon carbide substrate, or a silicon-on-insulator (SOI) substrate, but not limited thereto. The fused element 20 is disposed on the substrate 10. The auxiliary device 30 includes a source region 31 and a drain region 32 respectively disposed at two opposite sides of the fuse element 20. The auxiliary device 30 is configured to monitor and diagnose conditions of the fuse element 20. The source region 31 and the drain region 32 are electrically isolated from the fuse element 20.

More specifically, the fuse element 20 may be a stripe fuse extending along a first direction D1, and the source region 31 and the drain region 32 are disposed respectively at two opposite sides of the fuse element 20 in a second direction D2. The second direction D2 is perpendicular to the first direction D1. Additionally, the source region 31 and the drain region 32 of the auxiliary device 30 in this embodiment are disposed in the substrate 10, and the source region 31 and the drain region 32 may be doped regions in the substrate 10, but not limited thereto. The fuse element 20 may include a silicon layer 21 and a silicide layer 22 disposed on the silicon layer 21, but not limited thereto. The silicon layer 21 may include a polycrystalline silicon layer, and the silicide layer 22 may include a metal silicide layer, but not limited thereto.

In addition, the fuse structure 100 may further include an anode 23 and a cathode 24 disposed at two ends of the fuse element 20 in the first direction D1 respectively, and the anode 23 and the cathode 24 are electrically connected to the fuse element 20. A width of the anode 23 and a width of the cathode 23 in the second direction D2 are respectively larger than a width of the fuse element 20 in the second direction D2. The cathode 24 may be electrically connected to a blowing device (not shown) such as a drain electrode of a transistor, but not limited thereto. By applying a voltage to the anode 23 and controlling the transistor, an electric current flows from the anode 23 to the cathode 24 via the fuse element 20, and the electrons flow from the cathode 24 to the anode 23. As electro-migration becomes more and more violent by increasing the current density, an open circuit may be formed in the fuse element 20 or at the interface between the fuse element 20 and the anode 23 or the interface between the fuse element 20 and the cathode 24.

It is worth noting that the substrate 10 in this embodiment may further include a shallow trench isolation (STI) region 11 and an active region 12, and the shallow trench isolation region 11 surrounds the active region 12. The anode 23 and the cathode 24 of the fuse structure 100 are disposed on the STI region 11. The fuse element 20 is disposed between the anode 23 and the cathode 24, and the fuse element 20 is at least partially disposed on the active region 12. The source region 31 and the drain region 32 of the auxiliary device 30 are disposed in the active region 12, and the STI region 11 surrounds the source region 31 and the drain region 32 of the auxiliary device 30. The part of the fuse element 20 disposed between the source region 31 and the drain region 32 is used as a gate electrode 33 of the auxiliary device 30. In other words, the auxiliary device 30 further includes the gate electrode 33, and the gate electrode 33 includes a part of the fuse element 20 between the source region 31 and the drain region 32. Additionally, the fuse structure 100 may further include an oxide layer 13 disposed between the fuse element 20 and the substrate 10, and electrical measurement between the fuse element 20 (or may be referred as the gate electrode 33), the source region 31 and the drain region 32 of the auxiliary device 30 may be used to diagnose the conditions of the fuse element 20.

In addition, the fuse structure 100 in this embodiment may further include a plurality of first conductive plugs 41 and a plurality of second conductive plugs 42. The first conductive plugs 41 are disposed on the source region 31 and the drain region 32, and the second conductive plugs 42 are disposed on the anode 23 and the cathode 24. The first conductive plugs 41 and the second conductive plugs 42 may penetrate interlayer dielectrics (not shown) and contact the source region 31, the drain region 32, the anode 23 and the cathode 24 respectively for being electrically connected to the source region 31, the drain region 32, the anode 23 and the cathode 24 respectively, and upper ends of the first conductive plugs 41 and the second conductive plugs 42 may be electrically connected to other conductive layer, but not limited thereto. It is worth noting that cross-sectional shapes and cross-sectional areas of the second conductive plugs 42 may be substantially identical to one another, but the present invention is not limited to this. In other embodiments of the present invention, the cross-sectional shapes and the cross-sectional areas of a part of the second conductive plugs 42 may also be different from those of another part of the second conductive plugs 42 so as to control the location of the open circuit in the fuse element 20.

It is worth noting that the fuse structure 100 in this embodiment is described under the design of efuse, but the present invention is not limited to this. The present invention may also be applied to other kinds of fuse structures such as thermal fuses in which the open circuit conditions are formed by laser cutting.

Figure 4:
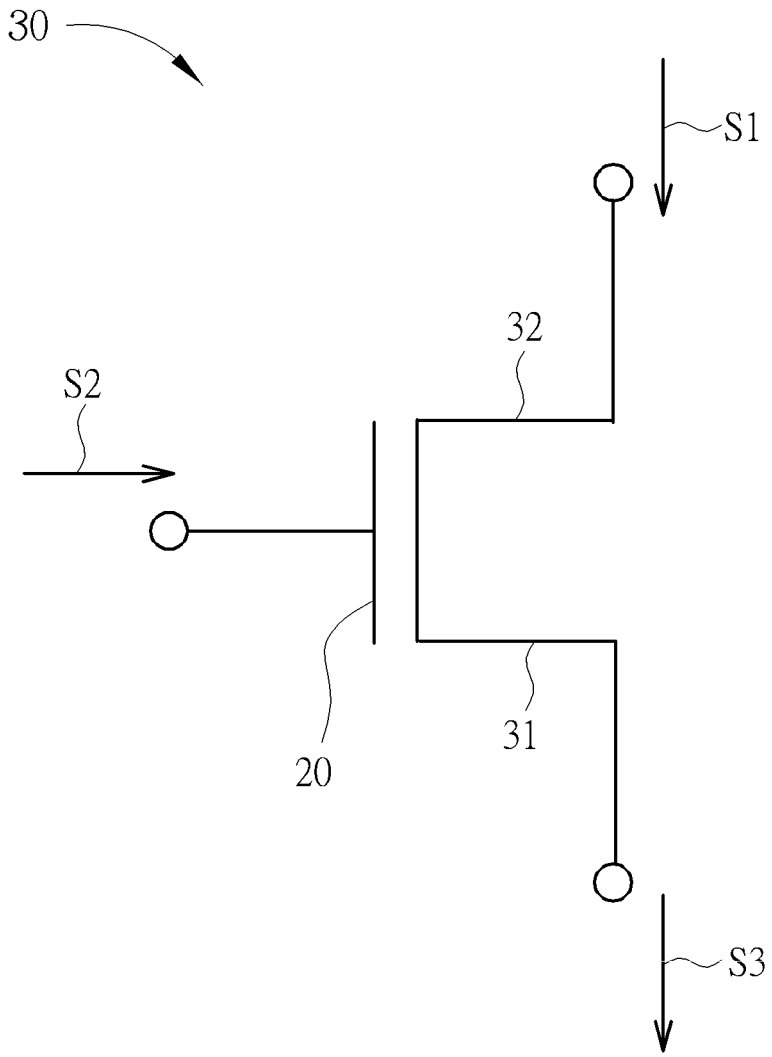
FIG. 4 is a schematic circuit diagram illustrating a monitoring method of a fuse structure according to a first preferred embodiment of the present invention.
Figure 5:
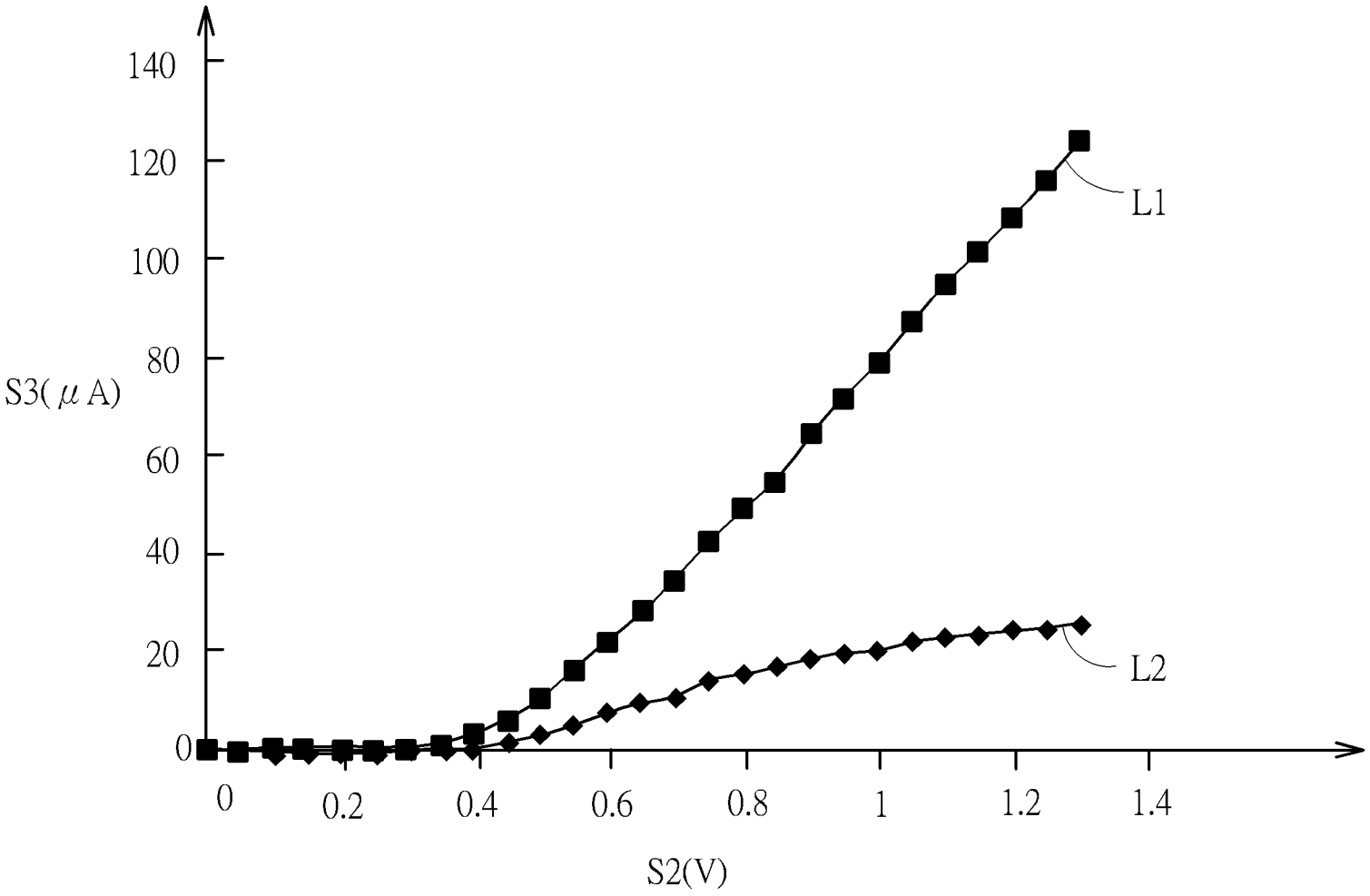
FIG. 5 is a schematic diagram illustrating a relation between a gate voltage signal and a drain current signal obtained by the monitoring method of the fuse structure before the fuse structure is blown according to the first preferred embodiment of the present invention.
Figure 6:
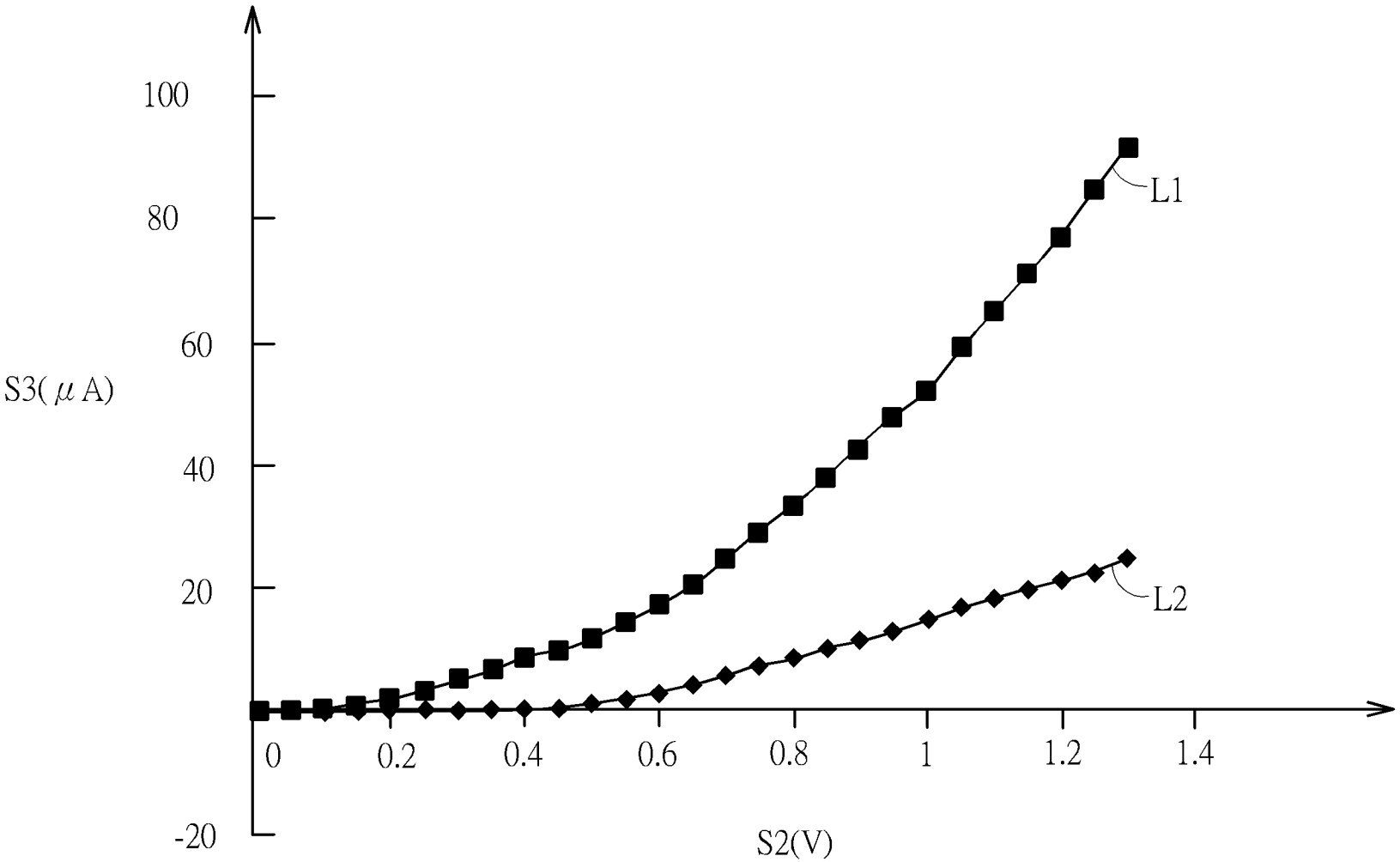
FIG. 6 is a schematic diagram illustrating the relation between the gate voltage signal and the drain current signal obtained by the monitoring method of the fuse structure after the fuse structure is blown according to the first preferred embodiment of the present invention.

Please refer to FIGS. 4-6 and FIG. 1. FIG. 4 is a schematic circuit diagram illustrating a monitoring method of a fuse structure according to a first preferred embodiment of the present invention. FIG. 5 is a schematic diagram illustrating a relation between a gate voltage signal and a drain current signal obtained by the monitoring method of the fuse structure before the fuse structure is blown according to this embodiment. FIG. 6 is a schematic diagram illustrating the relation between the gate voltage signal and the drain current signal obtained by the monitoring method of the fuse structure after the fuse structure is blown according to this embodiment. As shown in FIG. 1 and FIG. 4, a monitoring method of a fuse structure is provided in the first preferred embodiment of the present invention. The monitoring method includes following steps. First, the fuse structure 100 as described in the above embodiment is provided. Then, a drain voltage signal S1 is applied to the drain region 32 of the auxiliary device 30, a gate voltage signal S2 is applied to the gate electrode 33 (the part of the fuse element 20 between the source region 31 and the drain region 32), and a signal S3 from the source region 31 is obtained and analyzed to diagnose a condition of the fuse element 20.

For example, when the gate voltage signal S2 applied to the fuse element 20 varies from 0 volt to 1.3 volts by scanning, and the drain voltage signal S1 applied to the drain region 32 of the auxiliary device 30 is 0.1 volt or 1.3 volts, the signal S3 obtained from the source region 31 may be a drain current signal, and relation diagrams as FIG. 5 and FIG. 6 may be made accordingly. In FIG. 5 and FIG. 6, a first line L1 stands for a condition of the signal S3 when the drain voltage signal S1 is 1.3 volts, and a second line L2 stands for a condition of the signal S3 when the drain voltage signal S1 is 0.1 volt. As shown in FIG. 1, FIG. 4, and FIG. 5, the drain current (the signal S3) is relatively extremely low at specific gate voltage signal S2 before the fuse structure 100 is blown.

For example, when the gate voltage signal S2 is 0.3 volt, the corresponding drain current is around several nano amperes (nA). Comparatively, as shown in FIG. 1, FIG. 4, and FIG. 6, the drain current (the signal S3) is relatively higher at specific gate voltage signal S2 after the fuse structure 100 is blown. For example, when the gate voltage signal S2 is 0.3 volt, the corresponding drain current is around several micro amperes (μA). As shown in Table 1 below, the resistance of the fuse element 20 may become different after the fuse structure 100 is blown, and the resistance of the fuse element 20 may be higher than or equal to 1E+12 ohms or range between several hundred ohms and 1E+12 ohms for instance. The monitoring method of this embodiment may be used to measure the drain current value, and the condition of the drain current is a reference to judge whether the fuse element 20 is blown and whether the fuse element 20 can work normally. The principle of the measurement in this embodiment is similar to that of the one-time-programmable (OTP) read only memory, and the current increases after the fuse is blown.

TABLE 1

| | Resistance of the fuse element | Drain current |
|---|---|---|
| Before blowing | 500 ohms | Several nano amperes |
| After blowing-1 | 1E+12 ohms | Several micro amperes |
| After blowing-2 | 1E+15 ohms | Several micro amperes |

Figure 7:
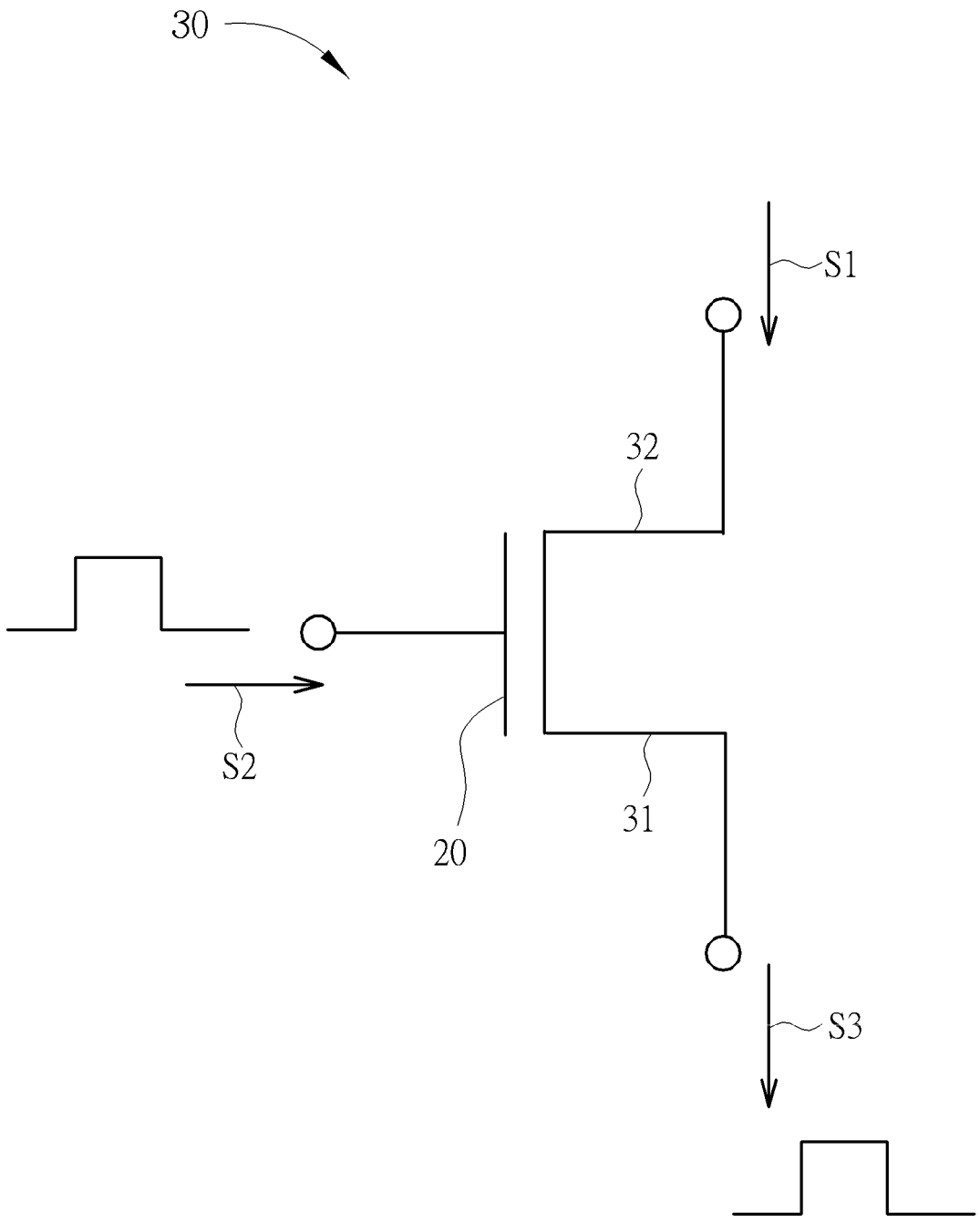
FIG. 7 is a schematic circuit diagram illustrating a monitoring method of a fuse structure according to a second preferred embodiment of the present invention.
Figure 8:
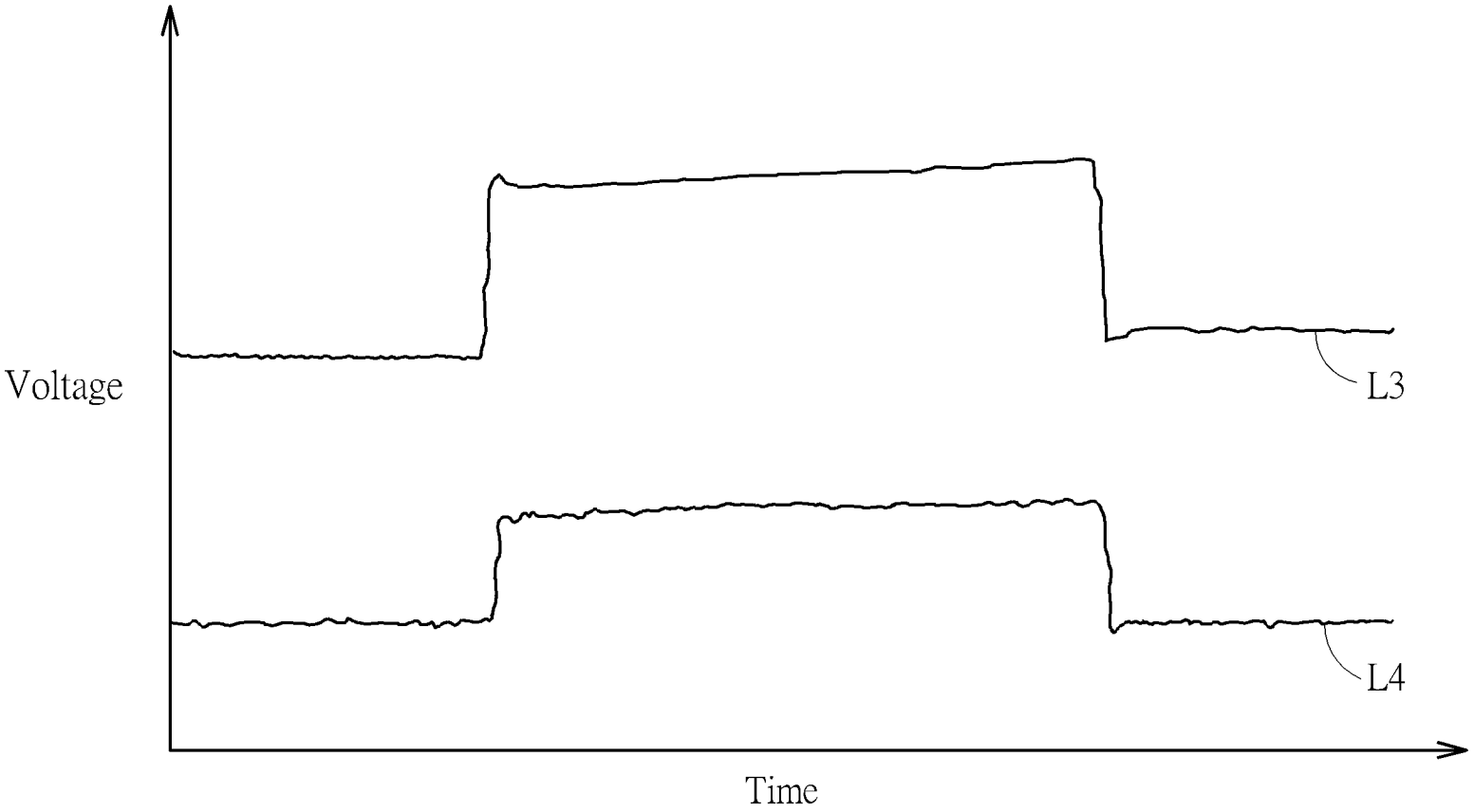
FIG. 8 is a schematic diagram illustrating a comparison between a pulse gate voltage signal and a reactive pulse voltage signal obtained by the monitoring method of the fuse structure before the fuse structure is blown according to the second preferred embodiment of the present invention.
Figure 9:
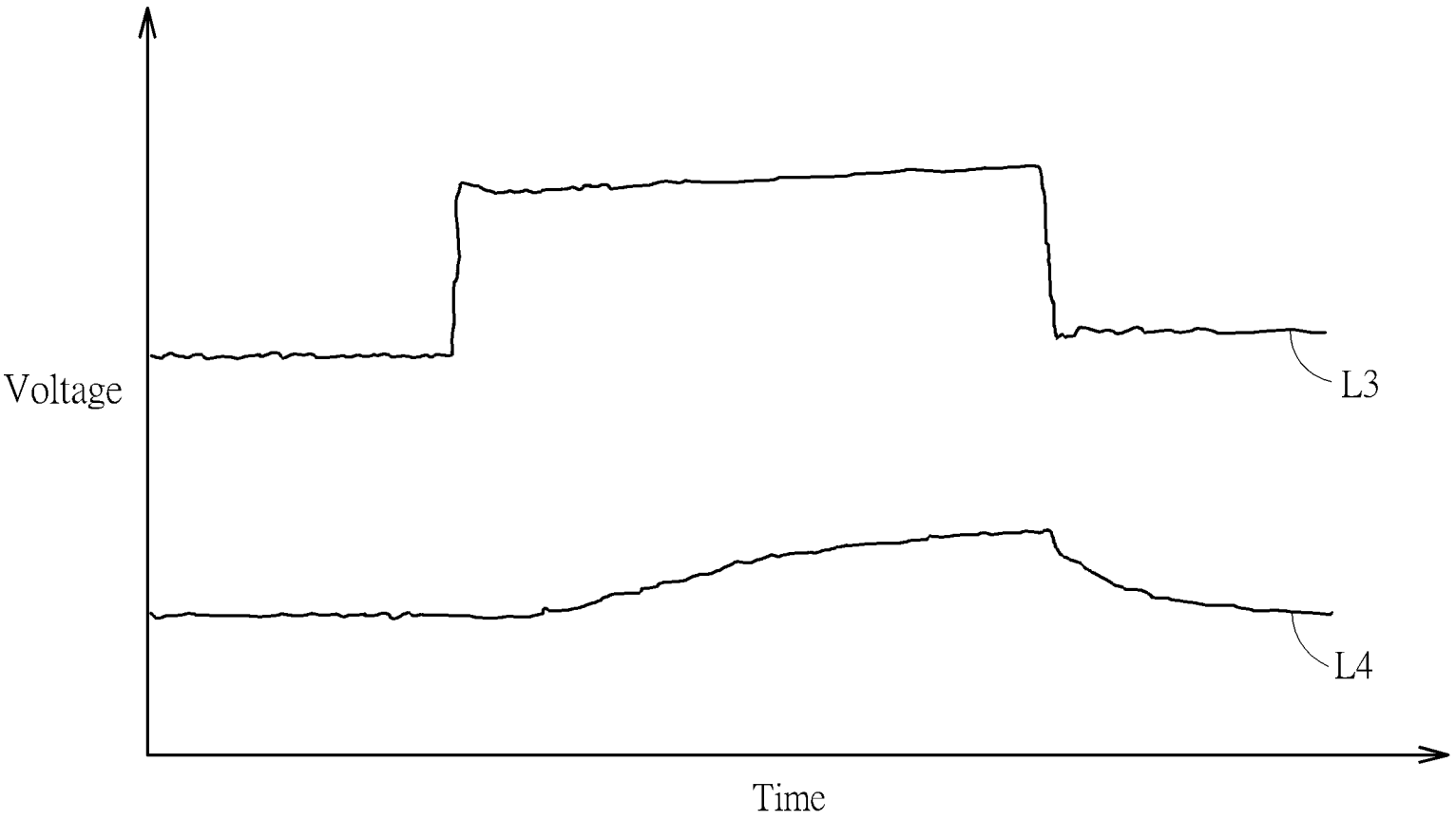
FIG. 9 is a schematic diagram illustrating the comparison between the pulse gate voltage signal and the reactive pulse voltage signal obtained by the monitoring method of the fuse structure after the fuse structure is blown out according to the second preferred embodiment of the present invention.

Please refer to FIGS. 7-9 and FIG. 1. FIG. 7 is a schematic circuit diagram illustrating a monitoring method of a fuse structure according to a second preferred embodiment of the present invention. FIG. 8 is a schematic diagram illustrating a comparison between a pulse gate voltage signal and a reactive pulse voltage signal obtained by the monitoring method of the fuse structure before the fuse structure is blown according to this embodiment. FIG. 9 is a schematic diagram illustrating the comparison between the pulse gate voltage signal and the reactive pulse voltage signal obtained by the monitoring method of the fuse structure after the fuse structure is blown out according to this embodiment. As shown in FIG. 1 and FIG. 7, the difference between the monitoring method of the fuse structure in this embodiment and the monitoring method in the first preferred embodiment is that the gate voltage signal S2 in this embodiment is a pulse gate voltage signal, and the signal S3 obtained from the source region 31 is a reactive pulse voltage signal.

For example, when the gate voltage signal S2 applied to the fuse element 20 is a pulse gate voltage signal with a period of 500 nanoseconds, the signal S3 obtained from the source region 31 may be a reactive pulse voltage signal, and relation diagrams as FIG. 8 and FIG. 9 may be made accordingly. In FIG. 8 and FIG. 9, a third line L3 stands for the pulse gate voltage signal and a fourth line stands for the reactive pulse voltage signal. As shown in FIG. 1, FIG. 7, and FIG. 8, the timing and the wave shape of the reactive pulse voltage signal are substantially similar to those of the pulse gate voltage signal before the fuse structure 100 is blown. Comparatively, as shown in FIG. 1, FIG. 7, and FIG. 9, the reactive pulse voltage signal need more time to start to increases gradually after the pulse gate voltage signal is applied. For instance, in FIG. 9, the reactive pulse voltage signal does not increase as the pulse gate voltage signal is applied for 40 nanoseconds. Additionally, the reactive pulse voltage signal also needs more time to go back to the original level. For instance, in FIG. 9, the reactive pulse voltage signal needs 40.5 nanoseconds to go back to the original level. As shown in Table 2 below, under the monitoring method of this embodiment, the drain current may be higher (about several micro amperes) after the pulse gate voltage signal is input when the fuse element 20 is not blown. Comparatively, after the fuse element 20 is blown, the drain current may become lower relatively (about several nano amperes). Therefore, the condition of the drain current may be a reference to judge whether the fuse element 20 is blown and whether the fuse element 20 can work normally.

TABLE 2

| | Resistance of the fuse element | Drain current (pulse signal) |
|---|---|---|
| Before blowing | 500 ohms | Several micro amperes |
| After blowing-1 | 1E+12 ohms | Several nano amperes |
| After blowing-2 | 1E+15 ohms | Several nano amperes |

It is worth noting that the present invention is not limited the monitoring methods of the fuse structure mentioned above. In other embodiments of the present invention, other appropriate measuring method may be applied to monitor the condition of the fuse structure 100. The monitoring method of the first preferred embodiment and the monitoring method of the second preferred embodiment may be applied to the fuse structure 100 respectively, and the measurement results from these two monitoring methods may be analyzed and compared with each other for further ensuring the conditions of the fuse element 20.

To summarize the above descriptions, in the fuse structure and the monitoring method of the fuse structure, the auxiliary device is used to measure electrical properties of the fuse element for monitoring and diagnosing conditions of the fuse element. Another way to diagnose the condition of the fuse element except the electrical resistance may be provided accordingly. The fuse structure and the monitoring method thereof in this invention may be used to avoid misjudging the fuse structure which can actually function normally with relatively lower resistance, and the manufacturing yield will not be influenced accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fuse structure, comprising:

a substrate, wherein the substrate comprises a shallow trench isolation (STI) region and an active region;

a fuse element disposed on the active region;

an anode and a cathode disposed at two ends of the fuse element respectively, wherein the anode and the cathode are disposed on the shallow trench isolation region; and an auxiliary device, wherein the auxiliary device comprises:

a source region and a drain region disposed at two opposite sides of the fuse element and in the active region; and a gate electrode, wherein the gate electrode includes a part of the fuse element between the source region and the drain region, wherein a monitoring method of the fuse structure comprises:

applying a drain voltage signal to the drain region of the auxiliary device;

applying a gate voltage signal to the fuse element; and analyzing a signal obtained from the source region of the auxiliary device.

2. The fuse structure of claim 1, wherein the source region and the drain region of the auxiliary device are disposed in the substrate.

3. The fuse structure of claim 1, wherein the fuse element comprises a silicon layer and a silicide layer disposed on the silicon layer.

4. The fuse structure of claim 1, further comprising an oxide layer disposed between the fuse element and the substrate.

5. The fuse structure of claim 1, wherein the shallow trench isolation region surrounds the source region and the drain region of the auxiliary device.

6. The fuse structure of claim 1, wherein the source region and the drain region are doped regions in the substrate.

7. The fuse structure of claim 1, wherein the substrate comprises a silicon substrate or a silicon on insulator (SOI) substrate.

8. The fuse structure according to claim 1, wherein the signal obtained from the source region is a current signal generated from the drain region.

9. The fuse structure according to claim 1, wherein the gate voltage signal is a pulse gate voltage signal, and the signal from the source region is a reactive pulse voltage signal.

* * * * *